United States Patent [19]

Jorzenink et al.

[11] 4,135,987

[45] Jan. 23, 1979

[54] APPARATUS FOR CLEANING THE BOTTOM SURFACE OF A COKE OVEN DOOR PLUG

[75] Inventors: Erich Jorzenink; Walter Stanke, both of Essen, Fed. Rep. of Germany

[73] Assignee: Krupp-Koppers GmbH, Essen, Fed. Rep. of Germany

[21] Appl. No.: 858,527

[22] Filed: Dec. 7, 1977

[30] Foreign Application Priority Data

Dec. 17, 1976 [DE] Fed. Rep. of Germany ..... 2657228

[51] Int. Cl.[2] ..... C10B 43/04

[52] U.S. Cl. ..... 202/241; 15/93 A; 201/2

[58] Field of Search ..... 202/241; 201/2; 15/93 A; 134/6, 39

[56] References Cited

U.S. PATENT DOCUMENTS

| | | | |
|---|---|---|---|
| 3,758,910 | 9/1973 | Lakeberg | 202/241 X |
| 3,774,258 | 11/1973 | Moreau | 202/241 X |
| 3,990,948 | 11/1976 | Lindgren | 202/241 |
| 4,000,043 | 12/1976 | Irwin | 202/241 |

*Primary Examiner*—Joseph Scovronek

*Attorney, Agent, or Firm*—Michael J. Striker

[57] ABSTRACT

A tool provided with a scraping edge is mounted on a support so that it can pivot about a substantially horizontal axis between a lower starting position, an upper end position and one or more intermediate positions in which the scraping edge of the tool engages the bottom surface of a coke oven door plug to scrape deposits off the same. An arrangement is provided for urging the tool towards its upper end position and thereby to make the scraping edge engage the bottom surface of the plug, and a tracking device prevents engagement of the scraping edge with the bottom surface of the plug unless the scraping edge is away from the region where the coke oven door is provided with a door seal.

6 Claims, 2 Drawing Figures

APPARATUS FOR CLEANING THE BOTTOM SURFACE OF A COKE OVEN DOOR PLUG

BACKGROUND OF THE INVENTION

The present invention relates to an apparatus for cleaning coke oven doors, and in particular to an apparatus for cleaning the bottom surface of a coke oven door plug.

Coke ovens have a plurality of chambers each of which is provided with an opening through which the finished coke is ultimately expelled. In operation of the coke oven these openings are closed by doors which can be inserted into the openings. To prevent the escape of dust and noxious gases through these openings the doors are provided with sealing surfaces which, when the respective door is seated in the associated opening, engage corresponding sealing surfaces on a frame which bounds the opening. Because of the deposits which form on these surfaces the latter must be cleaned from time to time, i.e., the deposits must be removed in order to obtain the desired sealing engagement between the surfaces on the door and on the frame bounding the opening of the respective coke oven chamber. For this purpose machinery exists, so-called door-cleaning machines, which clean the surfaces in question after the door has first been withdrawn in toto from the opening of the respective coke oven chamber.

However, these sealing surfaces are not the only ones which must be cleaned from time to time to remove deposits from them. The doors of coke oven chambers are basically composed of two sections, namely the actual door part which closes the opening and a projecting plug which extends from this door part into the coke oven chamber. This plug is made of a refractory material, such as fire brick or the like, and is supported from below by a metallic plug-supporting element that projects from the actual door part. Deposits form on the exposed lower surface of this supporting element and must be removed from time to time. Care must, however, be taken to avoid damaging the relatively readily damaged door seal which is located immediately adjacent to the plug. Heretofore the removal of deposits from the plug supporting element has been carried out manually, not only in order to avoid damaging the door seal but also because the original shape and position of the plug supporting element tend to change over a period of time due to the exposure of this element to heat and to the migration of graphite into the plug with a resultant change in the dimensions of the plug, which change then causes resultant changes in the shape and/or position of the plug supporting element. Of course, such manual work is time consuming and expensive and, moreover, it is hardly pleasant for the worker who is assigned to do it.

SUMMARY OF THE INVENTION

Accordingly, it is an object of the invention to overcome the disadvantages outlined above.

More particularly, it is an object of the invention to provide an apparatus for cleaning the bottom surface of a coke oven door plug, i.e., of the plug-supporting element which is a part of the plug.

Another object of the invention is to provide such an apparatus which is capable of cleaning the bottom surface of deposits, irrespective of changes in the shape and/or positioning of the plug-supporting element which may have taken place.

A concomitant object is to provide an apparatus of the type in question which properly cleans the bottom surface but does not damage the door seal.

In keeping with these objects, and with others which will become apparent hereafter, one feature of the invention resides, in an apparatus for cleaning the bottom surface of a coke oven door plug, in a combination which comprises a support, a tool having a scraping edge for scraping deposits off the bottom surface of a coke oven door plug, and mounting means mounting the tool on the support for pivoting about a substantially horizontal axis between a lower starting position, an upper end position and at least one intermediate position in which the scraping edge engages the bottom surface. Means are provided for urging the tool towards its upper end position and the scraping edge into yieldable engagement with the bottom surface.

The novel features which are considered as characteristic for the invention are set forth in particular in the appended claims. The invention itself, however, both as to its construction and its method of operation, together with addtional objects and advantages thereof, will be best understood from the following description of specific embodiments when read in connection with the accompanying drawings.

DESCRIPTION OF THE PREFERRED EMBODIMENTS

Figure 1:
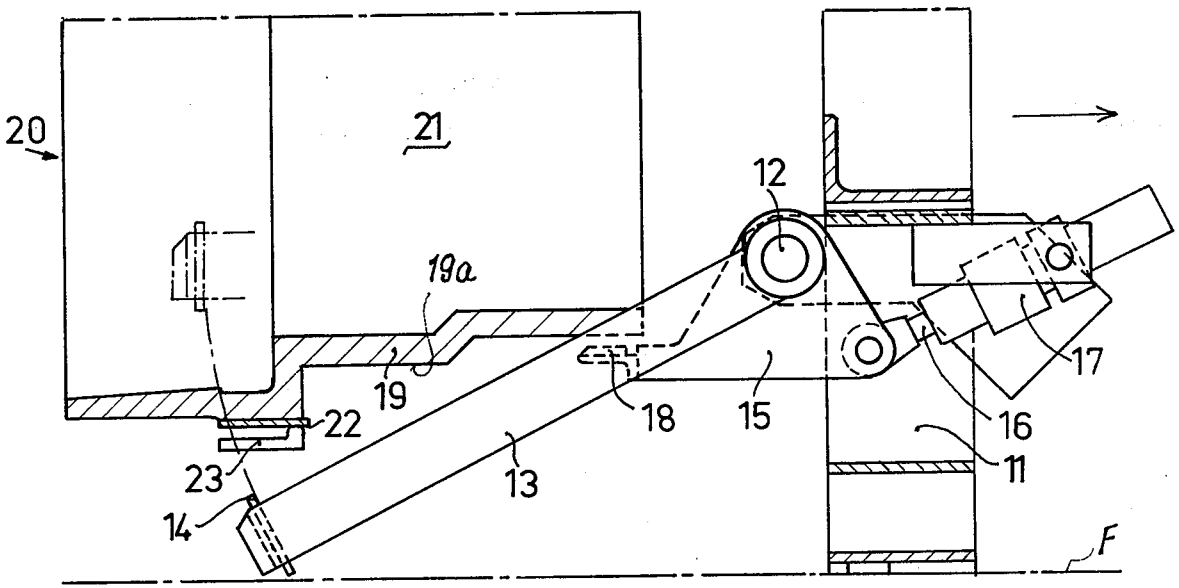
FIG. 1 is a fragmentary, partly sectioned and rather diagrammatic view illustrating an apparatus embodying the invention.
Figure 2:
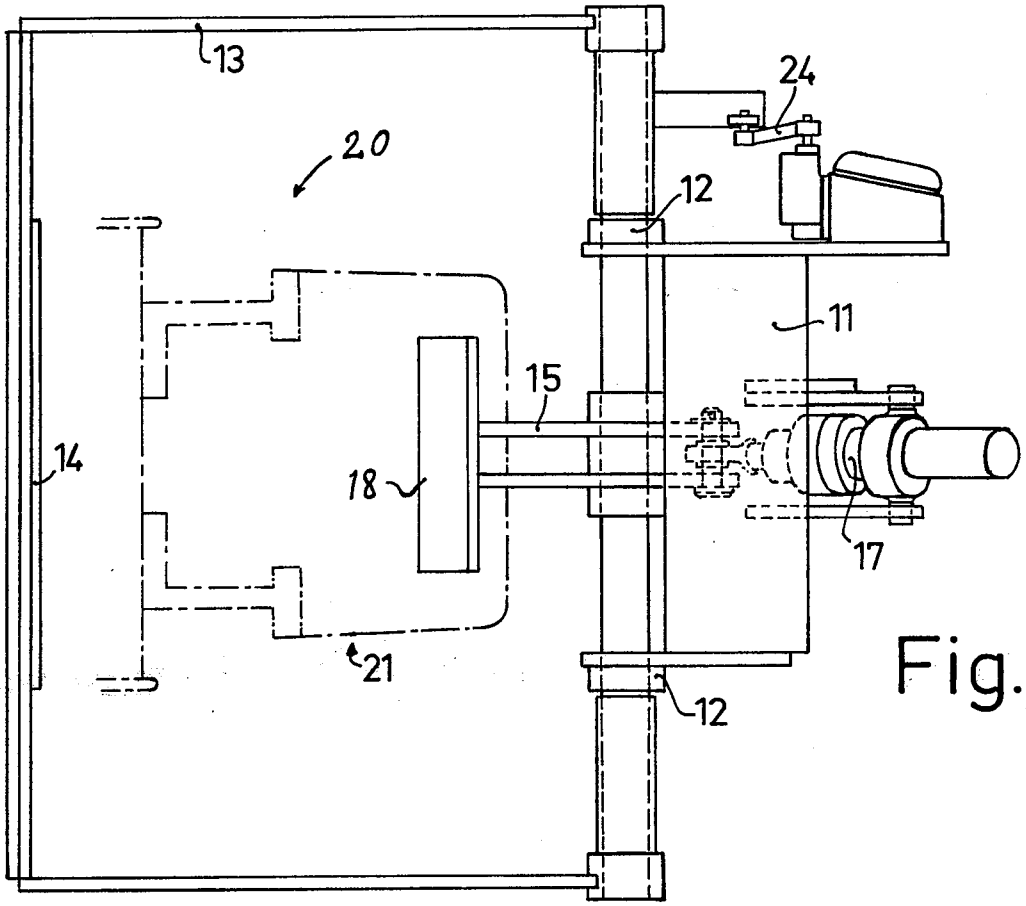
FIG. 2 is a top-plan view of the apparatus in FIG. 1.

Referring now to FIGS. 1 and 2 it is to be understood that only those elements of the apparatus have been illustrated which are necessary for an understanding of the invention. Also, it should be kept in mind that the coke oven chamber has not been shown and that the floor F which is shown in FIG. 1 is not the floor of the coke oven chamber but is a floor on or above which the door 20 for the coke oven chamber is supported after the door has been removed from the opening of the chamber.

Reference numeral 11 designates a support of the apparatus according to the present invention. This support is diagrammatically shown and can be a separate supporting element or, which is advantageous, it can be a part of a conventional door cleaning machine which is not illustrated in detail because it does not form a part of the invention and is known per se. Such a door cleaning machine is shown and described, e.g., in U.S. Pat. No. 3,464,074. What is important is that the support 11 carries a tool holder 13 which is secured to it by means of pivots 12 so that it can pivot about a horizontal pivot axis defined by the pivots 12. The free end of the tool holder 13 carries a tool having a horizontally extending scraping edge 14 (compare FIGS. 1 and 2) and the tool holder 13 is provided with one or more arms 15 to which the piston rod 16 of a fluid-operated (e.g., hydraulic) cylinder and piston unit 17 is articulately connected.

A tracking or sensing portion 18, here shown to be generally plate-shaped, is provided on the tool holder 13; in the illustrated embodiment it is provided on the arms 15 thereof which pivot about the pivot axis 12 at the same time as the entire tool holder 13 so pivots. When the tool holder 13 is in the starting position illustrated in solid lines in FIG. 1, the plate 18 is out of engagement with the lower or bottom surface 19a of the support element 19 on which the plug 21 of the coke oven door 20 is supported. The door is also provided with a door seal 22 which is located adjacent the plug 21 and secured to the door 20 by means of holding elements 23, of which one is illustrated in FIG. 1.

FIG. 2, it should be understood, is a top-plan view of the apparatus of FIG. 1; the door 20 with the plug 21 thereof has been shown superimposed in FIG. 2 in broken lines, so that the orientation of the apparatus with reference to the door can be readily determined. In actual fact, of course, the door will be located above the tool holder 13 of the apparatus, as more particularly shown in FIG. 1.

If, as has been found to be particularly advantageous and has been mentioned above, the apparatus according to the present invention is carried on and a part of a door cleaning machine which is known per se, the door cleaning machine is first moved into position relative to the door (after the door has been completely removed from the opening of the coke oven chamber) and the tool holder 13 at this time will assume the solid-line position of FIG. 1. Other elements of the conventional door cleaning machine will now be first operated in order to clean the door seal 22 which extends circumferentially of the door, and the vicinity of the door seal; to avoid interference with this cleaning operation, the tool holder 13 must be in the illustrated position of FIG. 1 where it is out of contact with the door. After this initial cleaning operation is completed, during which the apparatus according to the present invention does not perform any functions, the cleaning tools of the door cleaning machine are disengaged from the door and the apparatus according to the present invention is actuated while at the same time the door cleaning machine including the support 11 for the apparatus according to the present invention, moves back from the door in the direction of the arrow shown in FIG. 1.

As this movement is initiated the cylinder and piston unit 17 is actuated and causes the tool holder 13 to pivot about the pivot axis defined by the pivots 12 in upward direction, i.e., towards the bottom surface 19a of the support element 19. At this time, however, the scraping edge 14 would come into contact with the door seal 22 and/or the mounting elements 23 therefor and could cause damage to them. This is not permissible and, hence, the plate 18 is provided which engages the surface 19a before the scraping edge 14 can contact the elements 22, 23. The engagement between the element 18 and the surface 19a prevents further movement of the scraping edge 14 towards the surface 19a for as long as this engagement continues. The engagement will in fact continue until the machine of which the support 11 is a component has moved in the direction of the arrow in FIG. 1 to an extent sufficient for the plate 18 to come clear of (move rightwards beyond) the surface 19a. The pressure exerted by the cylinder and piston unit 17 now can further pivot the tool holder 13 in upward direction until the scraping edge 14 can engage the surface 19a. It will be noted that at this time the scraping edge 14 will have moved rightwards beyond the elements 22, 23 and will engage only the surface 19a so that it cannot damage the elements 22, 23. During the further movement of the machine in the direction of the arrow in FIG. 1 the edge 14, which is now being pressed by the cylinder and piston unit 17 against the surface 19a, scrapes deposits (such as tar or the like) from the surface 19a and thereby cleans the same. The fact that due to heat and/or graphite infusion into the refractory material of the plug 21 the support element 19 may have been pushed out of shape and/or out of position, will not prevent proper cleaning because the edge 14 will follow all contours of the surface 19a due to the fact that it has the capability of yielding and adapting itself to (tracking) the contours of the surface 19a because additional fluid will enter the cylinder and piston unit 17 if the contours of the surface 19a permit the scraping edge 14 to move farther upwardly or fluid will be expelled from the unit 17 if the contours of the surface 19a impose a downward movement upon the scraping edge 14.

The scraping operation is completed when the scraping edge 14 moves rightwardly beyond the surface 19a, i.e., beyond the right-hand end of the element 19, and at this time the tool holder 13 is urged to its upper end position under the influence of the cylinder and piston unit 17. This upper end position is shown in broken lines in FIG. 1; it should be understood that in this upper end position the tool 14 will be located at the level indicated by the broken lines but will, of course, not be located at the left-hand position where it is shown in broken lines but, instead, will be spaced rightwardly past the end of the plug 21. When the tool holder 13 reaches the broken-line upper end position the limit switch 24 is operated (compare FIG. 2) and causes the tool holder 13 to return to the solid-line position shown in FIG. 1 so that it is in readiness for being inserted beneath the next door to be cleaned in the manner described before.

It will be appreciated that the invention disclosed herein is susceptible of various modifications. For example, in place of the cylinder and piston unit 17 it would be possible to use a biasing spring, or more than one, or to use counterweights or the like. It will further be appreciated that instead of mounting the apparatus on a support 11 which forms part of a conventional door cleaning machine the support element could itself be a distinct movable element having no connection with the door cleaning machine.

While the invention has been illustrated and described as embodied in an apparatus for cleaning the bottom surface of a coke oven door plug, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Apparatus for cleaning the bottom surface of a coke oven door plug, comprising a support; a tool having a scraping edge for scraping deposits off the bottom surface of a coke oven door plug; mounting means mounting said tool on said support for pivoting about a substantially horizontal axis between a lower starting position, an upper end position and at least one intermediate position in which said scraping edge engages said bottom surface; and means for urging said tool towards said upper end position and said scraping edge into yieldable engagement with said bottom surface so that said scraping edge follows vertical contour variations of said bottom surface in response to relative movement of said tool and the door plug in direction axially of the latter.

2. Apparatus as defined in claim 1, said door plug having one end provided with a door seal and another end spaced from said one end in direction lengthwise of said plug, and said support being movable in said direction and away from said one end.

3. Apparatus as defined in claim 2; and further comprising means for preventing movement of said tool to said intermediate position until said support has moved in said direction by a distance requisite to avoid contact of said scraping edge with said door seal upon movement of the tool to said intermediate position.

4. Apparatus as defined in claim 3, said preventing means comprising a follower which rides on said bottom surface.

5. Apparatus as defined in claim 1, wherein said urging means comprises a fluid-operated cylinder-and-piston unit.

6. Apparatus as defined in claim 1, wherein said support is part of a coke-oven-door cleaning device.

* * * * *